US010190289B2

(12) United States Patent
Reyes-Rodriguez et al.

(10) Patent No.: US 10,190,289 B2
(45) Date of Patent: Jan. 29, 2019

(54) SYSTEMS AND METHODS FOR DETERMINING WEAR OF A GROUND-ENGAGING TOOL

(71) Applicant: Caterpillar Inc., Peoria, IL (US)

(72) Inventors: Solimar Reyes-Rodriguez, Edwards, IL (US); Maria Cristina Herrera De Kontz, Chillicothe, IL (US); Aloke Jude Mascarenhas, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 157 days.

(21) Appl. No.: 15/226,617

(22) Filed: Aug. 2, 2016

(65) Prior Publication Data

US 2018/0038083 A1 Feb. 8, 2018

(51) Int. Cl.
*E02F 9/26* (2006.01)
*G07C 5/08* (2006.01)
(Continued)

(52) U.S. Cl.
CPC ..... *E02F 9/267* (2013.01); *G07C 5/006* (2013.01); *G07C 5/0808* (2013.01); *G07C 5/0825* (2013.01); *G07C 5/0841* (2013.01); *E02F 3/32* (2013.01); *G07C 5/008* (2013.01); *G07C 5/085* (2013.01)

(58) Field of Classification Search
CPC .... G07C 5/006; G07C 5/0808; G07C 5/0841; G07C 5/0825; G07C 5/00; G07C 5/085; E02F 3/32; E02F 9/267
See application file for complete search history.

(56) References Cited

U.S. PATENT DOCUMENTS 6,917,846 B1 * 7/2005 Muller ..... G01G 19/083 700/108
9,243,381 B2 1/2016 Behmlander et al.
(Continued)

FOREIGN PATENT DOCUMENTS

WO 2013033164 A1 3/2013

OTHER PUBLICATIONS

"Monitoring Operational Mining Equipment Using Sprouts Wireless Sensor Network Platform", Ahmad El Kouche, Abdallah Alma'aitah, Hossam Hassanein, School of Computing, Queen's University, Kingston, Ontario, Canada.

*Primary Examiner* — Stephen Holwerda
(74) *Attorney, Agent, or Firm* — Miller, Matthias & Hull

(57) ABSTRACT

A method for monitoring wear of a ground-engaging tool associated with a machine in relation to productivity of the machine is disclosed. The ground-engaging tool defines an inner cavity and a first wall. The method includes receiving a first characteristic signal associated with the first wall from a first sensor, the first sensor operatively associated with the first wall. The method further includes receiving one or more productivity metrics associated with the machine from a performance monitoring system, the performance monitoring system operatively associated with the machine. The method further includes determining a first dimension of the ground-engaging tool based on the first characteristic signal, determining a first wear metric of the ground-engaging tool based on the first dimension, and correlating the first wear metric and the one or more productivity metrics.

20 Claims, 7 Drawing Sheets

(51) Int. Cl.
*G07C 5/00* (2006.01)
*E02F 3/32* (2006.01)

(56) References Cited

U.S. PATENT DOCUMENTS

2005/0261799 A1* 11/2005 Groth ..... E02F 3/435
700/180
2005/0278055 A1* 12/2005 Ferguson ..... G07C 5/0808
700/111
2006/0152352 A1* 7/2006 Moughler ..... B60C 23/04
340/438
2006/0243839 A9* 11/2006 Barscevicius ..... B02C 7/14
241/261.2
2009/0107219 A1* 4/2009 Douglas ..... G01N 35/00722
73/61.63
2010/0082267 A1* 4/2010 Schimert ..... G05B 19/4065
702/34
2011/0234391 A1* 9/2011 Barth ..... G07C 5/006
340/438
2014/0105481 A1* 4/2014 Hasselbusch ..... G06T 7/0006
382/141
2014/0173948 A1 6/2014 Ok et al.
2014/0311762 A1* 10/2014 Behmlander ..... E02F 3/8152
172/430
2014/0324301 A1* 10/2014 Rebinsky ..... E02F 9/267
701/50
2015/0149049 A1 5/2015 Bewley et al.
2015/0337522 A1 11/2015 Diekevers et al.

* cited by examiner

SYSTEMS AND METHODS FOR DETERMINING WEAR OF A GROUND-ENGAGING TOOL

TECHNICAL FIELD

The present disclosure generally relates to ground-engaging tools and, more particularly, to systems and methods for monitoring wear of ground-engaging tools.

BACKGROUND

Work machines, such as excavators and tele-handlers, are often used to control an implement, such as a bucket, to perform a given task at a construction and/or mining worksite. For example, such implements may be used for a variety of tasks in which the implement engages with the ground. These tasks may include digging, hauling, excavating, or any other task in which the implement, or an associated component, engages the ground. Accordingly, such implements often include, or are coupled with, ground-engaging tools. Ground-engaging tools may be utilized to protect the implement from undue wear and/or to perform additional, ground-engaging functions.

For example, a bucket operatively associated with a machine (e.g., an excavator) may include a plurality of ground-engaging tools that are affixed to the bucket such as, but not limited to, teeth, shrouds, adapters, and the like. Because such ground-engaging tools may be exposed to greater contact and friction than the bucket itself, ground-engaging tools are typically removable from the bucket and may be replaced multiple times over the course of the life of the machine and/or bucket.

Accordingly, it is often desired to monitor or otherwise observe wear conditions associated with ground-engaging tools, so that a machine operator may know how worn various ground-engaging tools are. However, wear of a ground-engaging tool may not always be easily observable by a party associated with the machine and, accordingly, systems have been developed that can monitor wear of ground-engaging tools.

In some example systems for monitoring wear of components of machines, visual sensors are used to detect or confirm edges of said components and can compare them with a baseline measure for a new part. For example, the systems and methods of U.S. Patent Application Publication No. 2015/0149049 ("Wear Part Monitoring") utilize a visual sensor affixed to the bucket of an excavator to visually monitor dimensions of a wear part, wherein a change in such dimensions may be indicative of wear.

However, while the systems of the '049 application may, generally, determine wear of a wear part associated with a bucket, they do not address the effect that wear may have on machine productivity. Therefore, systems for monitoring wear of a ground-engaging tool of a machine, in relation to productivity of the machine, are desired.

SUMMARY

In accordance with one aspect of the disclosure, a system for monitoring wear of a ground-engaging tool of a machine in relation to productivity of the machine is disclosed. The ground-engaging tool may defined an inner cavity and a first wall, the first wall extending in a first direction having an inner surface and an outer surface. The system may include a first ultrasonic sensor, a wireless receiver, a performance monitoring system, and a controller. The first ultrasonic sensor may be configured to transmit a first ultrasonic signal in the inner cavity and towards the inner surface, the first ultrasonic signal configured to travel through the first wall, from the inner surface, and reflect off the outer surface, at least in part, back towards the inner wall, receive the first ultrasonic signal upon reflection off of the outer surface, and transmit first signal trip characteristics associated with the first ultrasonic signal and based upon the transmission and subsequent receipt of the first ultrasonic signal. The wireless receiver may be configured for receiving the first signal trip characteristics transmitted by the first ultrasonic sensor. The performance monitoring system may be operatively associated with the machine and configured to determine one or more productivity metrics associated with the machine. The controller may include a processor and be operatively associated with the wireless receiver. The controller may be configured to receive the first signal trip characteristics, receive the one or more productivity metrics associated with the machine, determine a first dimension of the ground-engaging tool based on the first signal trip characteristics, determine a first wear metric of the ground-engaging tool based on the first dimension, and correlate the first wear metric and the one or more productivity metrics.

In accordance with another aspect of the disclosure, a method for monitoring wear of a ground-engaging tool associated with a machine in relation to productivity of the machine is disclosed. The ground-engaging tool may define an inner cavity and a first wall. The method may include receiving a first characteristic signal associated with the first wall from a first sensor, the first sensor operatively associated with the first wall. The method may further include receiving one or more productivity metrics associated with the machine from a performance monitoring system, the performance monitoring system operatively associated with the machine. The method may further include determining a first dimension of the ground-engaging tool based on the first characteristic signal, determining a first wear metric of the ground-engaging tool based on the first dimension, and correlating the first wear metric and the one or more productivity metrics.

In accordance with yet another aspect of the disclosure, a method for optimizing productivity of a machine based on wear of a ground-engaging tool associated with the machine is disclosed. The ground-engaging tool may define an inner cavity and a first wall. The method may include receiving a first characteristic signal associated with the first wall from a first sensor, the first sensor operatively associated with the first wall, determining a first dimension of the ground-engaging tool based on the first characteristic signal, and determining a first wear metric of the ground-engaging tool based on the first dimension. The method may further include receiving one or more productivity metrics associated with the machine from a performance monitoring system, the performance monitoring system operatively associated with the machine. The method may further include correlating the first wear metric and the one or more productivity metrics over the period of time and determining productivity changes over the period of time based on the correlation of the first wear metric and the one or more productivity metrics.

These and other aspects and features of the present disclosure will be better understood when read in conjunction with the accompanying drawings.

While the following detailed description will be given with respect to certain illustrative embodiments, it should be understood that the drawings are not necessarily to scale and the disclosed embodiments are sometimes illustrated diagrammatically and in partial views. In addition, in certain instances, details which are not necessary for an understanding of the disclosed subject matter or which render other details too difficult to perceive may have been omitted. It should therefore be understood that this disclosure is not limited to the particular embodiments disclosed and illustrated herein, but rather to a fair reading of the entire disclosure and claims, as well as any equivalents thereto.

DETAILED DESCRIPTION

Figure 1:
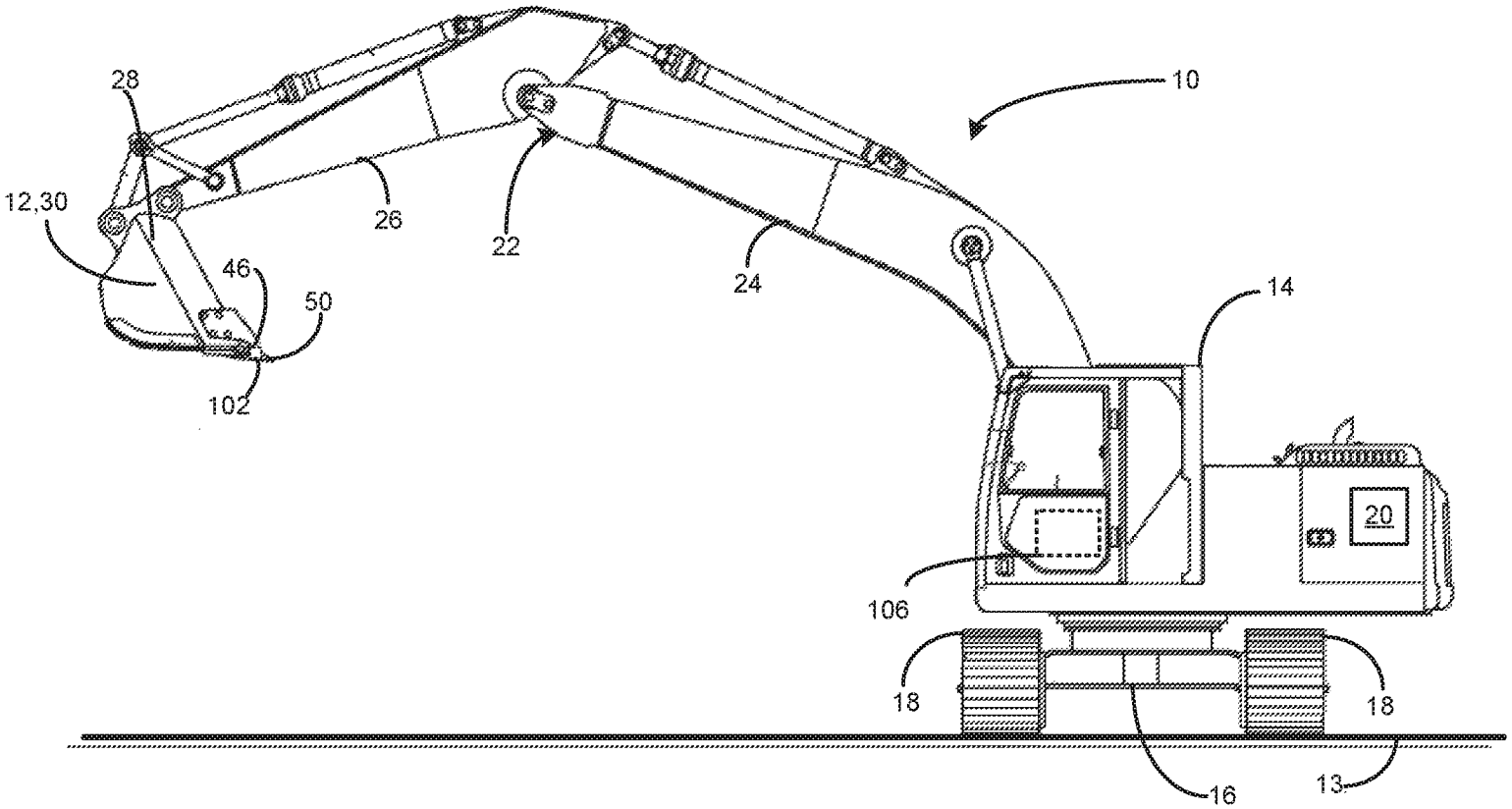
FIG. 1 is a side view of an example machine and elements of an example system for monitoring presence of one or more ground-engaging tools, in accordance with an embodiment of the present disclosure.

Turning now to the drawings and with specific reference to FIG. 1, a machine 10, utilizing an implement 12, is illustrated in accordance with the teachings of the present disclosure. While the machine 10 in FIG. 1 is depicted, generally, as an excavator-type machine, the teachings of the present disclosure may relate to other work machines that employ an implement associated with said machine. The term "machine" as used herein may refer to any machine that performs some type of operation associated with an industry such as construction, mining, farming, transportation, or any other industry known in the art. For example, the machine 10 may be a construction machine, such as a wheel loader, excavator, dump truck, backhoe, motor grader, material handler, tele-handler, or the like. Moreover, the implement 12 connected to the machine may be utilized for a variety of tasks including, but not limited to hauling, construction, loading, compacting, lifting, brushing and may include, for example, buckets, extruders, compactors, forked lifting devices, brushes, grapplers, cutters, shears, blades, breakers, hammers, augers, and the like. The machine 10 and implement 12 operate, in conjunction, to perform tasks on a worksite 13.

As depicted in FIG. 1, the machine 10 may include a housing 14 disposed on top of and supported by an undercarriage 16. The undercarriage 16 may be associated with one or more ground-engaging devices 18, which may be used for mobility and propulsion of the machine 10. The ground-engaging devices 18 are shown as a pair of continuous tracks; however, the ground-engaging devices 18 are not limited to being continuous tracks and may additionally or alternatively include other ground-engaging devices such as rotatable wheels. A power system 20 may provide power to the propel or otherwise move the ground-engaging devices 18 and may include one or more power sources, such as internal combustion engines, electric motors, fuel cells, batteries, ultra-capacitors, electric generators, and/or any power source which would be known by a person having ordinary skill in the art. Such a power system 20 may further be used to power various motions of the implement 12 or any other elements and control systems associated with the machine 10 and/or implement 12.

For controlling movements the implement 12, the machine 10 may further include a crane 22, which may include a boom 24 operatively coupled with a stick 26. The implement 12 may be attached to the crane 22 at, for example, a distal end 28 of the stick 26. In some examples, positioning of the implement 12, the crane 22 and, as associated elements, the boom 24 and stick 26, may be controlled by a control system (not shown).

Figure 2:
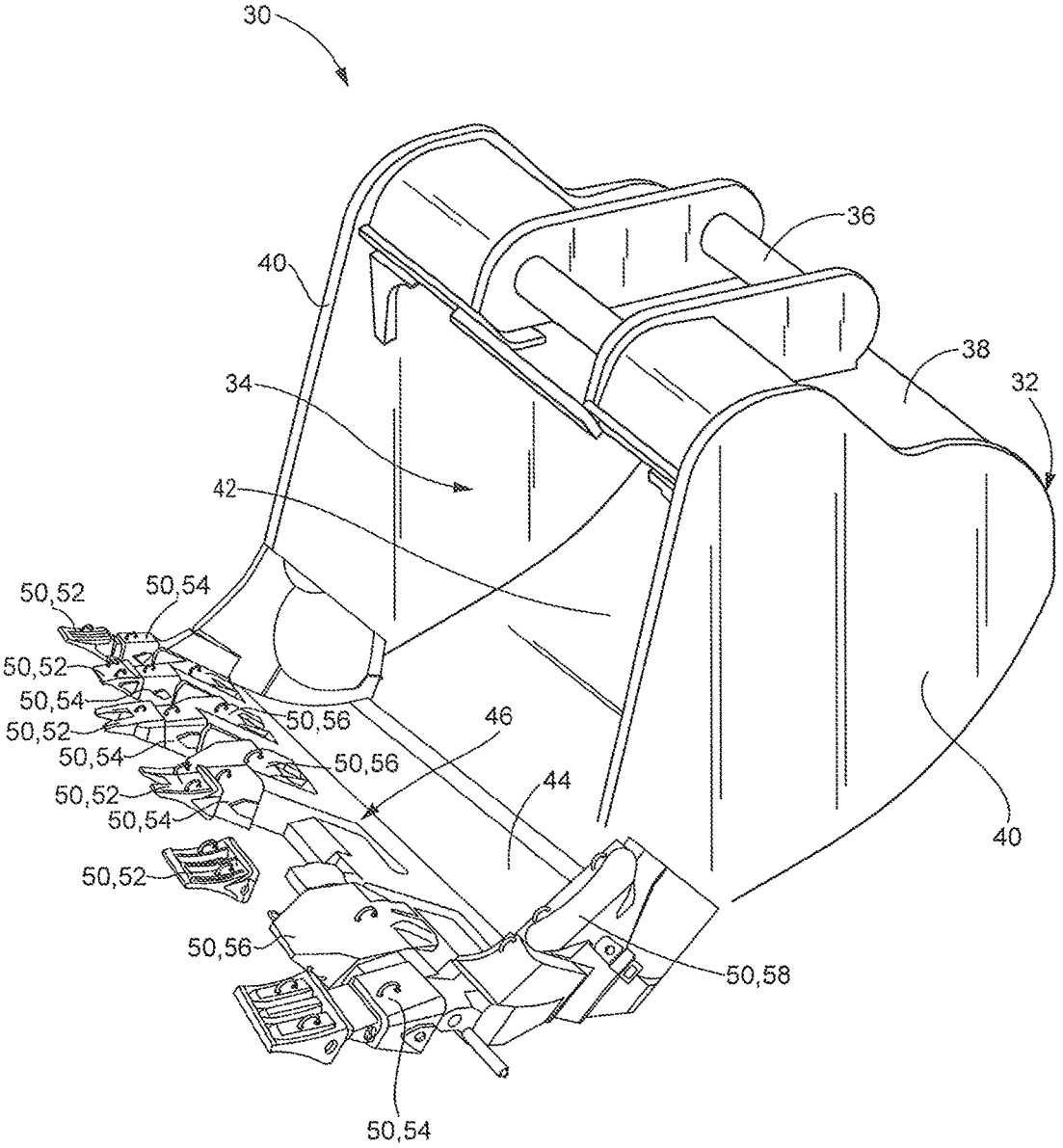
FIG. 2 is a perspective view of an example implement used in conjunction with the machine of FIG. 1, the implement having one or more ground-engaging tools associated therewith, in accordance with the present disclosure and FIG. 1.

In some examples, such as the illustrated embodiment, the implement 12 may be a bucket 30, which is shown in greater detail in FIG. 2. The bucket 30 may include a shell 32, which defines a cavity 34, in which materials may be carried during any material movement operations. In some examples, the bucket 30 may include a linkage 36, at which the bucket 30 may be connected to the crane 22, via, for example, the stick 26 of the crane 22. The linkage 36 may be formed or otherwise constructed atop a top wall 38 of the shell 32 of the bucket 30. Further, the shell 32 may include opposing side walls 40 and a back wall 42. At a forward end 44 of the back wall 42, the bucket 30 includes a lip 46. It is to be appreciated that the specific geometry, defined shape elements, and/or structure of the bucket 30 shown in FIG. 2 is non-limiting and the systems, methods, and machines disclosed herein are certainly applicable to systems, methods, and machines which employ buckets and/or implements having alternative geometry, defined shape elements, and/or structure than that of the bucket 30, illustrated in FIG. 2.

The lip 46 may be configured as a digging and/or ground-engaging portion of the bucket 30. Accordingly, the lip 46 may be the portion of the bucket 30 which leads contact with ground on a worksite, such as the worksite 13 of FIG. 1. To protect the bucket 30 and, in some examples, the lip 46, the bucket 30 may include, or be otherwise connectively associated with, one or more ground-engaging tools 50. The ground-engaging tools 50 may be utilized to protect the bucket 30 from undue wear and/or to perform additional, ground-engaging functions, such as breaking up ground on the worksite 13 in advance of the lip 46 making contact with the worksite 13. In some examples, the ground-engaging tools 50 may include, but are not limited to including, teeth 52, tooth adapters 54, lip shrouds 56, wing shrouds 58, and any other ground-engaging tools 50 known in the art. Because such ground-engaging tools 50 may be exposed to greater contact and friction than the bucket 30, itself, is exposed to, the ground-engaging tools 50 may be connectable and removable from the bucket 30.

Figure 3:
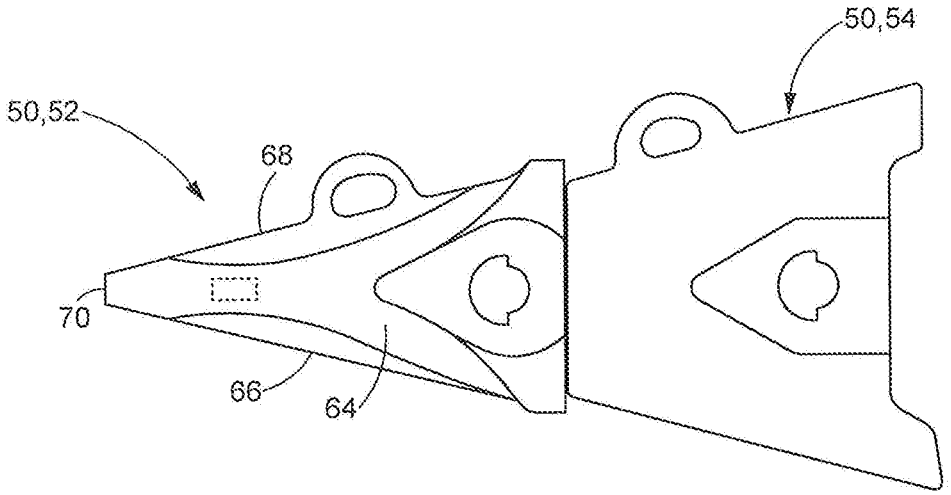
FIG. 3 is a side view of a tooth and associated adapter of the ground-engaging tools of FIG. 2, in accordance with the present disclosure and FIG. 2.
Figure 4:
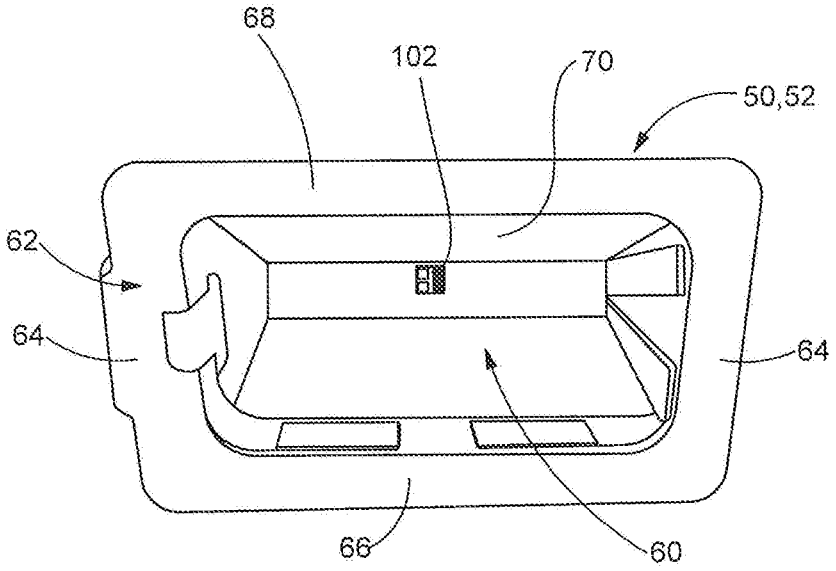
FIG. 4 is a rear view of the tooth of FIG. 3, illustrating an inner cavity of the tooth, in accordance with the present disclosure.

An example of one of the ground-engaging tools 50, more specifically one of the teeth 52, is illustrated in greater detail in FIGS. 3 and 4. FIG. 3 illustrates the tooth 52 in a side view and in connection with one of the tooth adapters 54. The tooth 52 may be connectively associated with the bucket 30 via the tooth adapter 54, however, it is certainly not limited to being connectively associated with the bucket 30 via the tooth adapter 54. For example, the tooth 52 may be directly connected to the lip 46 of the bucket 30 via any connective geometry of the lip 46 and/or any connective device associated with one or both of the lip 46 and the tooth 52. As shown best in FIG. 4, the tooth 52 may include an inner cavity 60, which is defined by a tooth shell 62 of the tooth 52. The tooth shell 62 may further define side walls 64, a bottom wall 66, a top wall 68, and an end wall 70. The inner cavity 60 may be configured to accept a connective element from the lip 46 and/or another ground-engaging tool 50, such as, but not limited to, the tooth adapter 54. It is to be appreciated that the specific geometry, defined shape elements, and/or structure of the tooth 52, the tooth adapter 54, and/or any ground-engaging tool 50 shown in FIGS. 3 and 4 are non-limiting and the systems, methods, and machines disclosed herein are certainly applicable to systems, methods, and machines which employ ground-engaging tools and/or wear parts having alternative geometry, defined shape elements, and/or structure than that of the tooth 52, the tooth adapter 54, and/or any ground-engaging tool 50 shown in FIGS. 3 and 4.

Because the ground-engaging tools 50 may wear down over time, a system 100 for monitoring wear of one or more of the ground-engaging tools 50 may be utilized. The system 100 is depicted schematically in FIG. 5 and some elements thereof are additionally illustrated in FIGS. 1-4. While the system 100 is described below as being utilized to monitor wear of the tooth 52, depicted in FIGS. 3, 4, 6, and 7, the system 100 may certainly be applicable to monitoring wear of any of the ground-engaging tools 50, such as the adapters 54, lip shrouds 56, and wing shrouds 58. Furthermore, the system 100 may be utilized to monitor wear of any ground-engaging tool or wear part known in the art.

Figure 6:
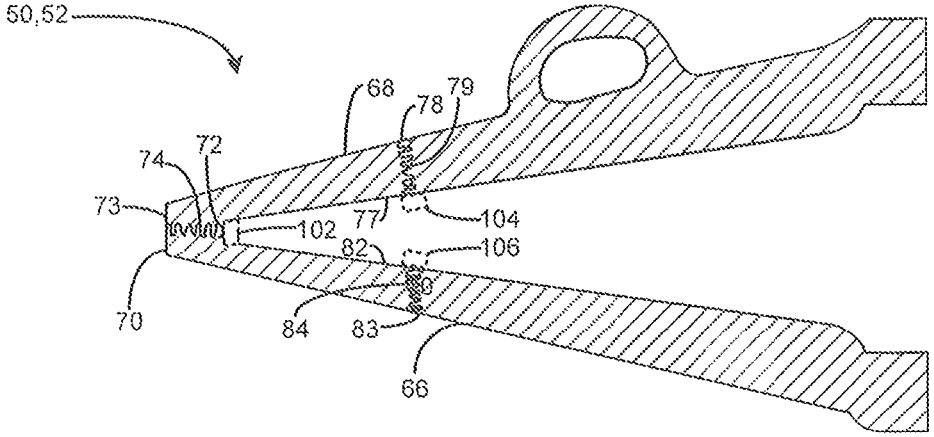
FIG. 6 is a side, cross-sectional view of the tooth of FIGS. 3 and 4, showing sensor placement and signal propagation within surfaces of the tooth, in accordance with an embodiment of the present disclosure.
Figure 7:
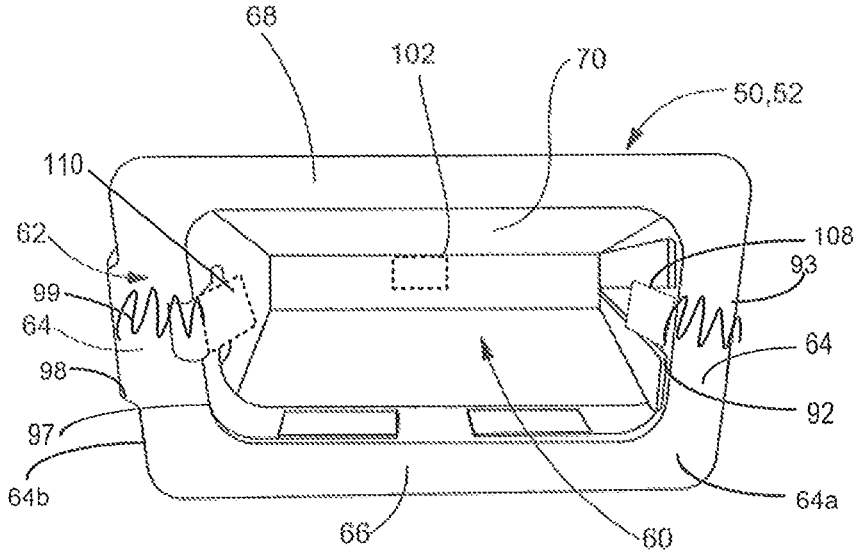
FIG. 7 is a rear view of the tooth of FIGS. 3, 4, and 6, illustrating the inner cavity of the tooth along with sensors placed therein and the resultant propagating signals within the surfaces of the tooth, in accordance with an embodiment of the present disclosure.

The system 100 may include one or more sensors, such as, for example, as a first sensor 102. The first sensor 102 may be configured to collect data associated with a structure of one of the ground-engaging tools 50. For example, as depicted in FIGS. 6 and 7, the first sensor 102 may be disposed proximate to the end wall 70 of the tooth 52, at an inner wall 72 of the end wall 70, which is within the inner cavity 60 of the tooth 52. The first sensor 102 may collect any data related to dimensions of the end wall 70 and/or any data from which dimensions of the end wall 70 may be determined or derived.

In some examples, the first sensor 102 may be an ultrasonic sensor configured to utilize reflection functions to determine a dimension of the end wall 70 (e.g., a distance between the inner wall 72 and the outer wall 73, which may define a width, length, or height of the end wall 70). In such examples, the first sensor 102 may transmit a first ultrasonic signal 74 in the inner cavity 60 and towards the inner wall 72, the first ultrasonic signal 74 configured to travel through the end wall 70, from the inner wall 72, and reflect off the outer wall 73, at least in part, back towards the inner wall 72. As defined herein, an ultrasonic signal may be any ultrasonic signal or series of ultrasonic signals. The first ultrasonic signal 74 may be, for example, a mechanical wave configured to propagate through structural elements of the tooth 52. Upon reflection of the first ultrasonic signal 74 off of the outer wall 73, the first ultrasonic signal 74 may be received by the first sensor 102. After receiving the first ultrasonic signal 74, the first sensor 102 may transmit signal characteristics associated with the first ultrasonic signal 74, the signal characteristics based upon the transmission and subsequent receipt of the first ultrasonic signal 74, with respect to the end wall 70. The first signal trip characteristics may include, but are not limited to including, a time of flight of the first ultrasonic signal 74 from the outer wall 73 to the inner wall 72, a speed of the first ultrasonic signal 74 as it travels through the end wall 70, and any other signal characteristics associated with the first ultrasonic signal 74.

Figure 5:
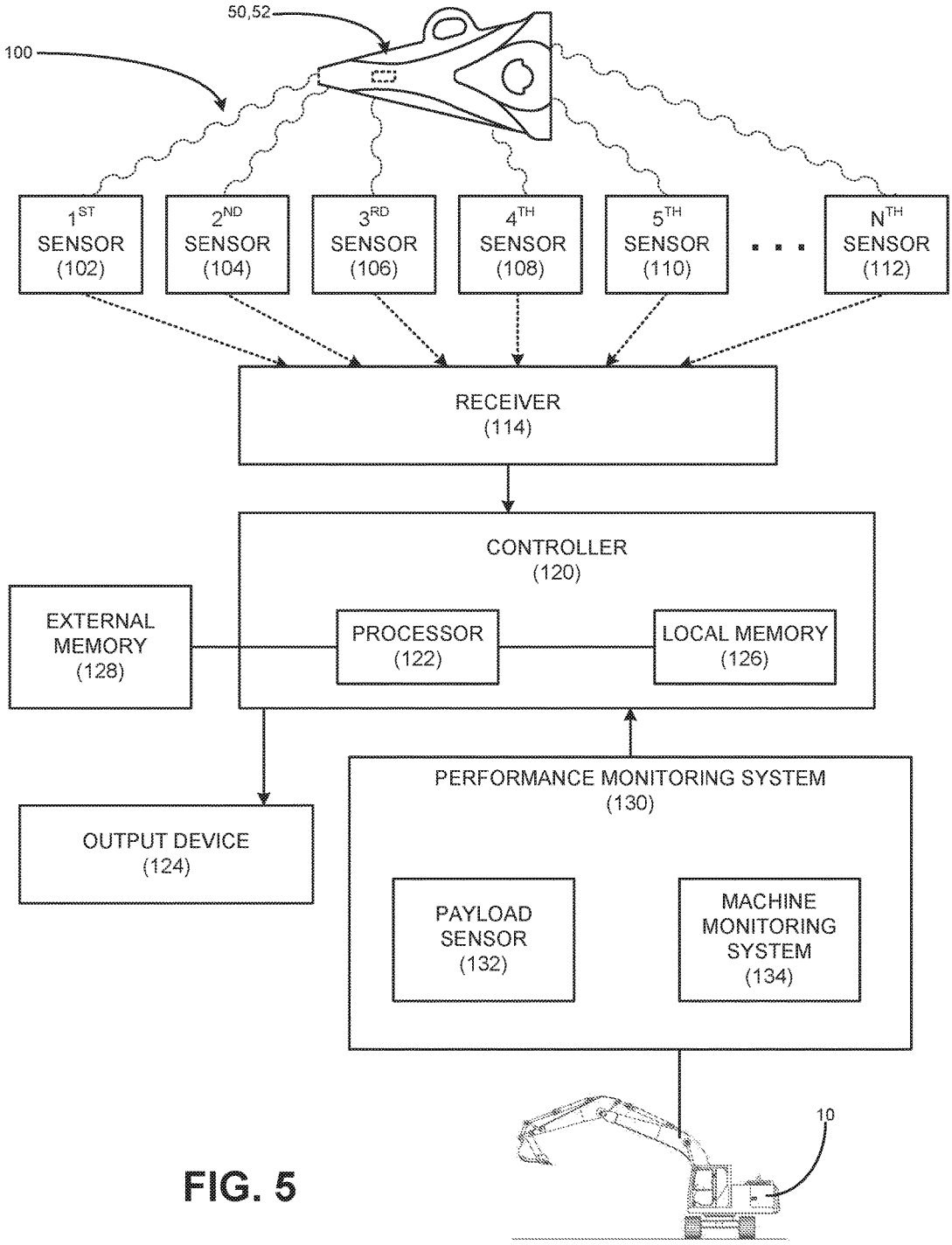
FIG. 5 is a schematic block diagram of the example system for monitoring wear of a ground-engaging tool of a machine in relation to productivity of the machine, in accordance with an embodiment of the disclosure and FIGS. 1-4.

As depicted in FIGS. 5-7, the system 100 may, optionally, include any number of sensors (e.g., a second sensor 104, a third sensor 106, a fourth sensor 108, a fifth sensor 110, up to an nth sensor 112) associated with the tooth 52 and configured to collect any data related to dimensions of the any wall and/or structure of the tooth 52 and/or any data from which dimensions of such walls and/or structures may be determined or derived. Any of the sensors 104, 106, 108, 110, 112 may function similarly to the first sensor 102, as described above. Similarly, any of the sensors 104, 106, 108, 112 may also be ultrasonic sensors configured to utilize reflection functions to determine one or more dimensions of a wall and/or structure of the tooth 52. For example, the second sensor 104 may transmit a second ultrasonic signal 79 in the inner cavity 60 and towards an inner wall 77 of the top wall 68, the second ultrasonic signal 79 configured to travel through the top wall 68, from the inner wall 77, and reflect off an outer wall 78 of the top wall 68, at least in part, back towards the inner wall 77. Upon receiving the second ultrasonic signal 79, the second sensor 104 may transmit signal characteristics associated with the second ultrasonic signal 79, the signal characteristics based upon the transmission and subsequent receipt of the second ultrasonic signal 79, with respect to the top wall 68. The second signal trip characteristics may include, but are not limited to including, a time of flight of the second ultrasonic signal 79 from the outer wall 78 to the inner wall 77, a speed of the second ultrasonic signal 79 as it travels through the top wall 68, and any other signal characteristics associated with the second ultrasonic signal 79.

In like manner of the functions of the sensors 102, 104, the third sensor 106 may utilize a third ultrasonic signal 84 to determine a dimension, or third signal characteristics indicative thereof, of the bottom wall 66, by reflecting the third ultrasonic signal 84 off an outer wall 83 towards an inner wall 82 of the bottom wall 66. Similarly, the fourth sensor 108 may utilize a fourth ultrasonic signal 94 to determine a dimension, or fourth signal characteristics indicative thereof, of a first side wall **64*a* by reflecting the fourth ultrasonic signal 94 off an outer wall 93 towards an inner wall 92 of the first side wall 66*a*. Likewise, the fifth sensor 110 may utilize a fifth ultrasonic signal 99 to determine a dimension, or fifth signal characteristics indicative thereof, of a second side wall 64*b* by reflecting the fifth ultrasonic signal 99 off an outer wall 98 towards an inner wall 97 of the second side wall 66*b*. Of course, any additional sensors (n number of sensors, up to the nth sensor 112) may be included for determining any dimensions of walls and/or structures of the tooth 52. While the description below of the system 100 will, generally, refer to the usage and functions of the sensor 102, it is to be understood that such usage and functions may be repeated for any of the sensors 104, 106, 108, 110, 112. Further, data collected by any of the sensors 104, 106, 108, 110, 112 may be utilized by the system 100 in addition to or as an alternative to the data collected by the sensor 102** and utilized by associated elements, as described below.

It is to be understood that placement of the sensors 104, 106, 108, 110, 112 of FIG. 6 is merely exemplary and the sensors 106, 106, 108, 110, 112 may be placed anywhere proximate to the tooth 52, in which data related to dimensions of any wall and/or structure of the tooth 52 and/or any data from which dimensions of such walls and/or structures may be determined or derived. In some examples, one or more of the sensors 104, 106, 108, 110, 112 may be affixed relative to a part with which the tooth 52 engages (e.g., adapters 54, connective geometry of the lip 46, and/or any other ground-engaging tool 50). In such examples, the sensors 104, 106, 108, 110, 112 similarly monitor geometry of walls of the tooth 52. Of course, any other example configuration for sensor placement, wherein any wall and/or structure of the tooth 52 and/or any data from which dimensions of such walls and/or structures may be determined or derived, are certainly possible.

As mentioned above, the sensor 102 may be configured to transmit the first signal trip characteristics. Accordingly, the sensor 102 may be capable of transmitting wireless signals that are identifiable as transmitted from the sensor 102 and receivable by a wireless signal receiver. For example, the sensor 102 may be capable of transmitting a Bluetooth signal, a radio frequency (RF) signal, a Wi-Fi signal, or any other wireless, propagating signal. For example, the sensor 102 may be a Bluetooth low energy (BLE) tag that transmits a low energy, wireless signal about a given range, the low energy, wireless signal being receivable by a receiver configured to detect such low energy signals.

For detecting and receiving wireless signals transmitted by the sensor 102 and carrying the first signal trip characteristics, the system 100 may include one or more signal receivers, such as a wireless receiver 114. The wireless receiver 114 may be positioned at a location proximate to the machine 10. In the non-limiting example of FIG. 1, the wireless receiver 114 is located proximate to the housing 14 of the machine 10. Additionally or alternatively, the receiver 114 or an additional receiver may be positioned in a vehicle (e.g., a hauling unit) proximate to the machine 10. In another non-limiting example wherein the sensor 102 is a BLE tag, the wireless receiver 114 may be a "client" associated with the sensor 102, which acts as a "server" in accordance with the application programming interface software associated with BLE tag technology, known in the art. However, as mentioned above, because the sensor 102 may be configured to transmit any wireless signal carrying the first signal trip characteristics, the corresponding wireless receiver 114 may be any receiver configured to receive said wireless signal carrying signal trip characteristics.

Further, the system 100 may include a performance monitoring system 130, which is operatively associated with the machine 10 and configured to determine one or more productivity metrics associated with the machine 10. In some examples, the one or more productivity metrics are determined over a period of time. The one or more productivity metrics may be any metrics associated with machine productivity and/or efficiency, such as, but not limited to, payload, fuel efficiency, machine movement efficiency versus time, machine health over time, and the like. In some examples, the performance monitoring system 130 may include a payload sensor 132 operatively associated with the machine 10. In such examples, the one or more performance metrics may include payload information determined by the payload sensor 132 over a period of time. For example, the payload sensor 132 may be operatively associated with the bucket 30 and may track payload hauled by the bucket 30, over a period of time; the tracked payload may then be used as one of the one or more performance metrics. In some other examples, the performance monitoring system 130 may include a machine monitoring system 134 operatively associated with the machine 10. In such examples, the one or more performance metrics may include machine efficiency information, determined by the machine monitoring system 134, over a period of time. For example, the machine monitoring system 134 may monitor any machine characteristics, such as speeds, fuel usage, fuel efficiency, machine movements, task tracking, or any other characteristics which may be analyzed over a period of time to determine comparable characteristics relevant to efficiency. Of course, the performance monitoring system 130 may include any additional or alternative devices, sub-systems, and/or processes useful for determining performance metrics associated with the machine 10.

To utilize, at least, the first signal trip characteristics transmitted by the sensor 102 and received by the wireless receiver 114, the system 100 may further include a controller 120, which includes, at least, a processor 122. The controller 120 may be any electronic controller or computing system including a processor which operates to perform operations, execute control algorithms, store data, retrieve data, gather data, and/or any other computing or monitoring task desired. The controller 120 may be a single controller or may include more than one controller disposed to interact with one or more of the sensors 102, 104, 106, 108, 110, 112, the wireless receiver 114, the performance monitoring system 130, and, optionally, an output device 124. Functionality of the controller 120 may be implemented in hardware and/or software and may rely on one or more data maps. To that end, the controller 120 may include internal memory 126 and/or the controller 120 may be otherwise connected to external memory 128, such as a database or server. The internal memory 126 and/or external memory 128 may include, but are not limited to including, one or more of read only memory (ROM), random access memory (RAM), a portable memory, and the like. Such memory media are examples of nontransitory memory media.

The controller 120 may be configured to execute instructions which, when executed, monitor wear of the tooth 52 in relation to productivity of the machine 10. While the described embodiment details monitoring of the wear of the tooth 52 in relation to productivity of the machine 10, it is to be appreciated that the described system 100 is also applicable to monitoring wear of any of the ground-engaging devices 50 discussed above and/or for monitoring wear of any other ground-engaging tools or wear parts known in the art.

For monitoring wear of the tooth 52 in relation to machine productivity, the controller 120 may receive the first signal trip characteristics from the first sensor 102 and the controller 120 may receive the one or more productivity metrics from the performance monitoring system 130. Utilizing, at least, the first signal trip characteristics, the controller 120 may determine a first dimension of the tooth 52. In the present example, the first dimension of the tooth 52 may be a width of the end wall 70; however, the first dimension may be any height, length, width, or other dimension associated with any wall or structure of the tooth 52.

Utilizing the first dimension and/or any other dimensions associated with the tooth 52, the controller 120 may determine a first wear metric of the tooth 52 based on the first metric. The first wear metric may be any data which indicates wear of the tooth 52 based on a prior dimension determined for the tooth 52. For example, the wear metric may be a width of wear when the first dimension is a width of the end wall 70; the width of wear may be determined by the controller 120 by comparing the first dimension to a stored value for the original width of the tooth 52, prior to any wear from being used during work by the machine 10. Of course, the first wear metric may indicate wear on any surface of the tooth 52 and is certainly not limited to indicate wear of the end wall 70. Alternatively, the wear metric may record degradation in a wall or surface of the tooth 52 over a period of time by, for example, comparing currently collected dimension data versus prior monitoring of a similar dimension.

In determining the wear metric, the first dimension may be compared versus stored data, to obtain the wear metric. Such stored data may be stored on one or both of the internal memory 126 and the external memory 128. The stored data may be any look-up tables, data tables, and/or memory stores, which may be used to determine the first wear metric of the tooth 52.

The controller 120 may be configured to then correlate the first wear metric, along with, optionally, any additional wear metrics received, with the one or more productivity metrics. By correlating the wear metrics with the productivity metrics, information may be gained related to proper replacement time for the tooth 52 and/or information regarding efficiency losses at various states of wear for the tooth 52. For example, the controller 120 may be further configured to determine an optimal time for replacing the tooth 52, with respect to the machine 10 and/or the bucket 30, based on the correlation of the wear metric(s) and the one or more productivity metrics. In some such examples, the controller 120 may further be configured to transmit an output signal to output device 124 when it is the optimal time for replacing the tooth 52. The output device 124 may be any visual, audio, or tactile output device suitable for presenting an alert to an operator or monitoring party associated with the machine 10.

In some examples, wherein multiple additional sensors (e.g., one or more of the sensors 104, 106, 108, 110, 112) are employed in the system 100, the controller 120 may be further configured to determine additional dimensions of the tooth 52. For example, the controller 120 may utilize second signal trip characteristics determined by the second sensor 104 to determine a second dimension of the tooth 52 based on said second signal trip characteristics. Similarly, the controller 120 may determine a second wear metric of the tooth 52 based on the second dimension, in a similar manner to that in which it determines the first wear metric, and said second wear metric may also be correlated with the one or more productivity metrics. In such examples, the controller 120 may further be configured to determine a wear profile for the tooth 52 based on the first wear metric, the second wear metric, and, optionally, any additional wear metrics. The wear profile may be a data set and/or model for the tooth 52 which indicates wear in two or more dimensions of one or more walls and/or structures of the tooth 52. Further, in examples wherein a wear profile is determined, the controller 120 may further determine if the tooth 52 needs replacement based on the correlation of the wear profile and the one or more productivity metrics.

INDUSTRIAL APPLICABILITY

In general, the foregoing disclosure finds utility in various industries, employing machines, in which ground-engaging tools and/or wear parts are utilized in conjunction with the machines. By utilizing the systems and methods disclosed herein, wear of ground-engaging tools may be monitored in conjunction with machine productivity, such that ground-engaging tools may be properly replaced to optimize efficiency and/or optimize machine component cost. Maintaining knowledge of the relationship between ground-engaging tool wear and machine productivity is useful in improving productivity of the machine and, in general, improving a working operation at a worksite. If a ground-engaging tool is improperly worn, it could hinder the quality and/or efficiency of operation of said machine. Therefore, the systems and methods herein may be utilized to optimize machine operation quality and/or efficiency.

Figure 8:
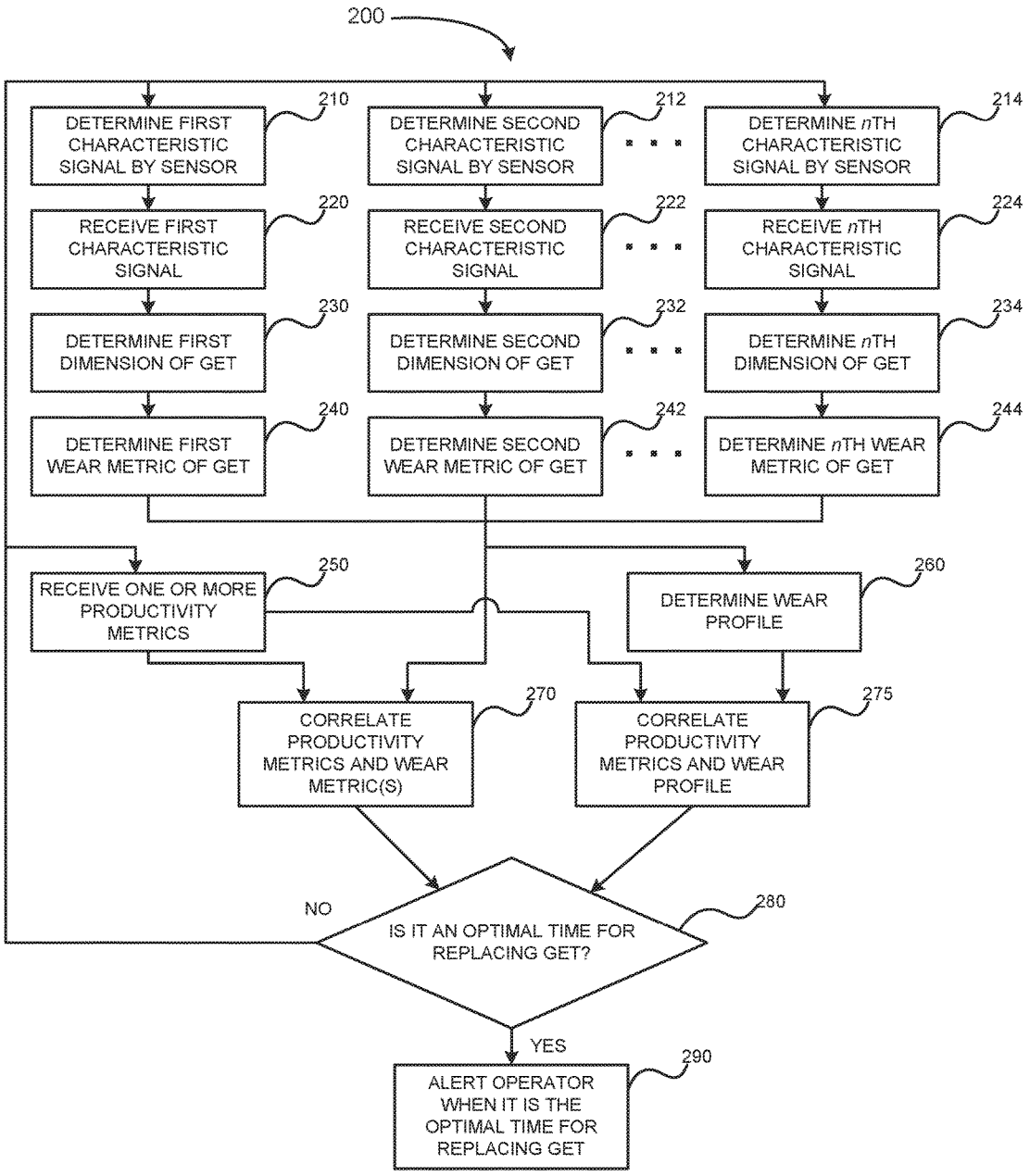
FIG. 8 is an example flowchart illustrating a method for monitoring wear of a ground-engaging tool associated with a machine in relation to productivity of the machine, in accordance with an embodiment of the present disclosure.

In order to optimize machine operation quality and/or efficiency, the system 100 for monitoring wear of a ground-engaging tool of a machine in relation to productivity of the machine, discussed above, may be employed. The system 100 may be utilized in addition to or in conjunction with a method 200 for monitoring wear of a ground-engaging tool associated with a machine and in relation to productivity of the machine 10. The method 200 is exemplified by the flowchart of FIG. 8. While the description of the method 200 presented below references elements of the system 100, the method 200 may be executed using alternative elements and should not be construed as limited to execution via the system 100 and/or components thereof. As depicted in FIG. 8, the term "ground-engaging tool" is abbreviated in acronym form, as "GET."

The method 200 may include determining a first characteristic signal associated with a first wall (e.g., the end wall 70), utilizing the first sensor 102, which is operatively associated with the first wall, as depicted in block 210. To determine the first characteristic signal, as discussed above, at block 210 the first sensor 102 may transmit a first ultrasonic signal 74 in the inner cavity 60 and towards the inner wall 72, the first ultrasonic signal 74 configured to travel through the first wall, from the inner wall 72, and reflect off the outer wall 73, at least in part, back towards the inner wall 72. In such examples, the first sensor 102 may receive the first ultrasonic signal 74, upon reflection off the outer wall 73, and determine the first characteristic signal based upon the transmission and subsequent receipt of the first ultrasonic signal 74. In some examples, the method 200 may further include determining additional characteristic signals by additional sensors, each additional characteristic signal associated with a surface and/or wall of the tooth 52. In such examples, the method 200 may further include determining a second characteristic signal by a second sensor 104 and determining n additional characteristic signals by n sensors blocks 212, 214.

The first characteristic signal may then be received from the first sensor 102 by, for example, utilizing one or both of the wireless receiver 114 and the controller 120, as depicted in block 220. Similarly, in examples wherein multiple characteristic signals are generated, the second characteristic signal and any additional characteristic signals, up to an nth characteristic signal, may be received by, for example, utilizing one or both of the wireless receiver 114 and the controller 120, as depicted in blocks 222 and 224. Based on the first characteristic signal, the controller 120 may determine a first dimension of the tooth 52, as depicted in block 230 and described above. Similarly, the controller 120 may determine a second dimension of the tooth 52 based on the second characteristic signal and may determine any additional dimensions (nth dimensions) of the tooth 52 based on n characteristic signals received, as depicted in blocks 232 and 234. Based on the first dimension of the tooth 52 determined at block 230, the controller 120 may further determine a first wear metric of the tooth 52, as depicted in block 240. Similarly, in some examples, the controller 120 may determine a second wear metric of the tooth 52 and/or n additional wear metrics based on n dimensions determined, as depicted in blocks 242 and 244. In some such examples, the method 200 may include determining a wear profile based on the multiple determined wear metrics (e.g., the first wear metric, the second wear metric, up to the nth wear metric), as depicted in block 260.

The method 200 may further include receiving one or more productivity metrics associated with the machine 10 from the performance monitoring system 130, as depicted in block 250, wherein the performance monitoring system 130 is operatively associated with the machine 10. Utilizing the one or more productivity metrics, the first wear metric, and, optionally, any additional wear metrics, the controller 120 may correlate the one or more productivity metrics and the wear metric(s), as depicted in block 270. In examples wherein a wear profile is determined, the controller 120 may correlate the productivity metrics and the wear profile, as well, as depicted in block 275. Utilizing the results of one or both of blocks 270, 275, the controller 120 may determine if it is an optimal time for replacing the tooth 52 based on the correlation of the wear metric(s) and the one or more productivity metrics, as depicted in block 280. Additionally or alternatively, the controller 120 may determine if it is an optimal time for replacing the tooth 52 based on the correlation of the wear profile and the one or more productivity metrics. If the controller 120 determines it is the optimal time for replacing the tooth 52, then an alert may be presented to an operator of the machine 10 by, for example, the output device(s) 124, as depicted in block 290. Otherwise, the method 200 may continue to monitor wear of the tooth 52.

Figure 9:
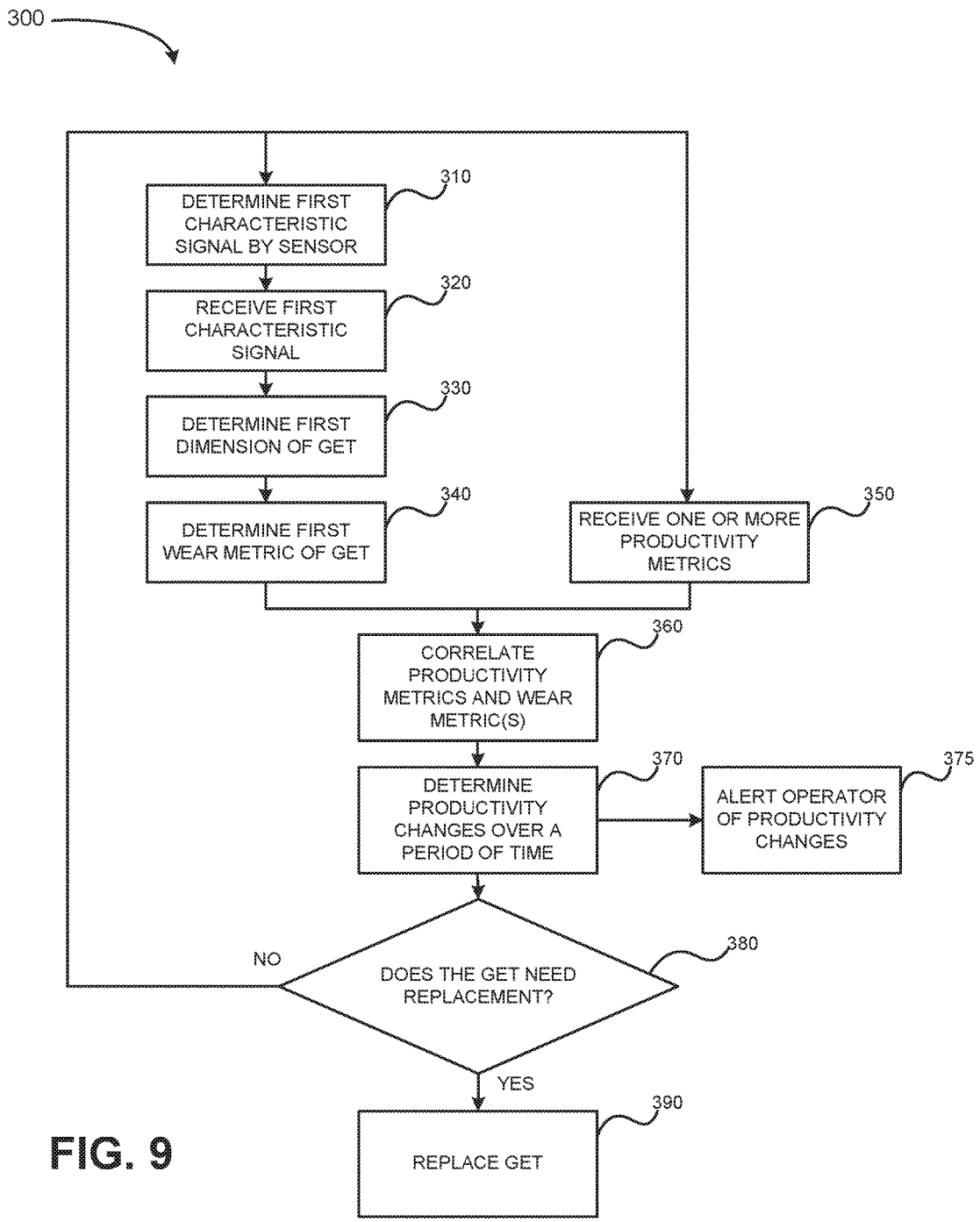
FIG. 9 is an example flowchart illustrating a method for optimizing productivity of a machine based on wear of a ground-engaging tool associated with the machine, in accordance with an embodiment of the present disclosure.

The system 100 may further be utilized for optimizing productivity of the machine 10, based on wear of the tooth 52. In some examples, the system 100 may be utilized as an operator assist feature, which may provide information regarding trends for wear of a ground-engaging tool versus productivity of the machine 10. For example, a method 300 for optimizing productivity of the machine 10, based on wear of the tooth 52, as depicted in the flow chart of FIG. 9, may be employed. While the description of the method 200 presented below references elements of the system 100, the method 200 may be executed using alternative elements and should not be construed as limited to execution via the system 100 and/or components thereof. As depicted in FIG. 9, the term "ground-engaging tool" is abbreviated in an acronym form, as "GET."

The method 300 may include determining a first characteristic signal associated with a first wall (e.g., the end wall 70), utilizing the first sensor 102, which is operatively associated with the first wall, as depicted in block 310. The first characteristic signal may then be received from the first sensor 102 by, for example, utilizing one or both of the wireless receiver 114 and the controller 120, as depicted in block 320. Based on the first characteristic signal, the controller 120 may determine a first dimension of the tooth 52, as depicted in block 330 and described above. Based on the first dimension of the tooth 52 determined at block 330, the controller 120 may further determine a first wear metric of the tooth 52, as depicted in block 340. Of course, the steps of blocks 310, 320, 330, 340 may be repeated for any number of data sets related to dimensions of walls and/or structures of the tooth 52, up to n determinations.

The method 300 may further include receiving one or more productivity metric associated with the machine 10, over a period of time, from the performance monitoring system 130, as depicted in block 350. Utilizing the one or more productivity metrics, the first wear metric, and, optionally, any additional wear metrics, the controller 120 may correlate the one or more productivity metrics and the wear metric(s) over the period of time, as depicted in block 360. Such a correlation may be utilized, as shown in the steps below and described below, to monitor the tooth 52 for replacement. However, the correlation may be used for any productivity-related data collection, such as, but not limited to, creating a databased to determine what wear trends for the tooth 52 provide greater productivity and comparing such trends, in real time, to the productivity achieved by an operator. Further, the correlation obtained at block 360 may be used to create any operator assist features to guide an operator to follow the best productivity trends associated with wear of a ground-engaging tool.

The controller 120 may then determine productivity changes over the period of time based on the correlation of the first wear metric and the one or more productivity metrics, as depicted in block 370. In some examples, the method 200 may include alerting the operator of the machine 10 of the productivity changes over the period of time via, for example, the output device(s) 124, as depicted in block 375. Further, based on the determined productivity changes over the period of time, the controller 120 may determine if the tooth 52 needs replacement, as depicted in block 380. If the productivity changes indicate that wear of the tooth 52 contributed to the productivity changes, then the method 300 may include replacing the tooth 52 with a replacement tooth 52, as depicted in block 390. Otherwise, the method 300 may continue to monitor wear of the tooth 52 to optimize productivity of the machine 10.

It will be appreciated that the present disclosure provides control systems for implements of machines, which utilize orientation leveling systems. While only certain embodiments have been set forth, alternatives and modifications will be apparent from the above description to those skilled in the art. These and other alternatives are considered equivalents and within the spirit and scope of this disclosure and the appended claims.

What is claimed is:

1. A system for monitoring wear of a ground-engaging tool of a machine in relation to productivity of the machine, the ground-engaging tool defining an inner cavity and a first wall, the first wall extending in a first direction having an inner surface and an outer surface, the system comprising:

a first ultrasonic sensor configured to:

transmit a first ultrasonic signal in the inner cavity and towards the inner surface, the first ultrasonic signal configured to travel through the first wall, from the inner surface, and reflect off the outer surface, at least in part, back towards the inner surface;

receive the first ultrasonic signal upon reflection off of the outer surface; and transmit first signal trip characteristics associated with the first ultrasonic signal and based upon the transmission and subsequent receipt of the first ultrasonic signal;

a wireless receiver for receiving the first signal trip characteristics transmitted by the first ultrasonic sensor;

a performance monitoring system sensor configured to sense a machine efficiency characteristic of the machine during operation of the machine;

a performance monitoring system operatively associated with the machine and configured to determine one or more productivity metrics associated with a productivity or an efficiency of the machine based on the machine efficiency characteristic sensed by the performance monitoring system sensor; and a controller, including a processor, operatively associated with the wireless receiver and configured to:

receive the first signal trip characteristics;

receive the one or more productivity metrics associated with the machine;

determine a first dimension of the ground-engaging tool based on the first signal trip characteristics;

determine a first wear metric of the ground-engaging tool based on the first dimension; and correlate the first wear metric and the one or more productivity metrics to determine a relationship between wear on the ground-engaging tool and efficiency losses in the operation of the machine.

2. The system of claim 1, wherein the controller is further configured to determine an optimal time for replacing the ground-engaging tool based on the correlation of the first wear metric and the one or more productivity metrics.

3. The system of claim 2, further comprising an output device configured to output an alert to an operator of the machine based on input from the controller and wherein the controller is further configured to transmit an output signal to the output device when it is the optimal time for replacing the ground-engaging tool.

4. The system of claim 1, wherein the performance monitoring system sensor comprises, at least, a payload sensor operatively associated with the machine and wherein the one or more performance metrics includes payload information determined by the payload sensor over a period of time.

5. The system of claim 4, wherein correlating the first wear metric and the one or more productivity metrics by the controller includes correlating the first wear metric and the payload information over the period of time.

6. The system of claim 1, wherein the performance monitoring system includes, at least, a machine monitoring system operatively associated with the machine and wherein the one or more performance metrics includes machine efficiency information determined by the performance monitoring system over a period of time.

7. The system of claim 6, wherein correlating the first wear metric and the one or more productivity metrics by the controller includes correlating the first wear metric and the machine efficiency information over the period of time.

8. The system of claim 1, wherein the first signal trip characteristics include one or more of a time of flight of the first ultrasonic signal, a speed of the first ultrasonic signal as it travels through the first wall, and any combinations thereof.

9. The system of claim 1, wherein the ground-engaging tool further defines a second wall extending in a second direction and having a second inner surface and a second outer surface, the system further comprising a second ultrasonic sensor configured to:

transmit a second ultrasonic signal in the inner cavity and towards the second inner surface, the second ultrasonic signal configured to travel through the second wall, from the second inner surface, and reflect off the second outer surface, at least in part, back towards the second inner surface;

receive the second ultrasonic signal upon reflection off of the second outer surface; and transmit second signal trip characteristics associated with the second ultrasonic signal upon transmission and subsequent receipt; and wherein the controller is further configured to:

receive the second signal trip characteristics;

determine a second dimension of the ground-engaging tool based on the second signal trip characteristics;

determine a second wear metric of the ground-engaging tool based on the second dimension; and correlate the second wear metric and the one or more productivity metrics to determine a relationship between wear on the ground-engaging tool and efficiency losses in the operation of the machine.

10. The system of claim 9, wherein the controller is further configured to:

determine a wear profile for the ground-engaging tool based on the first wear metric and the second wear metric;

correlate the wear profile and the one or more productivity metrics to determine a relationship between wear on the ground-engaging tool and efficiency losses in the operation of the machine; and determine if the ground-engaging tool needs replacement based on the correlation of the wear profile and the one or more productivity metrics.

11. The system of claim 1, wherein the ground-engaging tool is one or more of a tooth, an adapter, a lip shroud, a wing shroud, a blade segment, and any combinations thereof.

12. A method for monitoring wear of a ground-engaging tool associated with a machine in relation to productivity of the machine, the ground-engaging tool defining an inner cavity and a first wall, the method comprising:

receiving a first characteristic signal associated with the first wall from a first sensor, the first sensor operatively associated with the first wall;

receiving one or more productivity metrics associated with a productivity or an efficiency of the machine from a performance monitoring system, the performance monitoring system operatively associated with the machine, and the productivity metrics being determined by the performance monitoring system based on a machine efficiency characteristic sensed by a performance monitoring system sensor;

determining a first dimension of the ground-engaging tool based on the first characteristic signal;

determining a first wear metric of the ground-engaging tool based on the first dimension; and correlating the first wear metric and the one or more productivity metrics to determine a relationship between wear on the ground-engaging tool and efficiency losses in the operation of the machine.

13. The method of claim 12, further comprising determining an optimal time for replacing the ground-engaging tool based on the correlation of the first wear metric and the one or more productivity metrics.

14. The method of claim 13, further comprising presenting an alert to an operator of the machine when it is the optimal time for replacing the ground-engaging tool.

15. The method of claim 12, wherein the first wall extends in a first direction and has an inner surface and an outer surface, and wherein the method further comprises:

transmitting, by the sensor, a first ultrasonic signal in the inner cavity and towards the inner surface, the first ultrasonic signal configured to travel through the first wall, from the inner surface, and reflect off the outer surface, at least in part, back towards the inner surface; and receiving, by the sensor, the first ultrasonic signal upon reflection off of the outer surface;

determining the first characteristic signal based upon the transmission and subsequent receipt of the first ultrasonic signal.

16. The method of claim 12, wherein the ground-engaging tool further defines a second wall extending in a second direction, the method further comprising:

receiving a second characteristic signal associated with the second wall from a second sensor, the second sensor operatively associated with the second wall;

determining a second dimension of the ground-engaging tool based on the second characteristic signal;

correlating the second wear metric and the one or more productivity metrics to determine a relationship between wear on the ground-engaging tool and efficiency losses in the operation of the machine.

17. The method of claim 16, further comprising:

determining a wear profile for the ground-engaging tool based on the first wear metric and the second wear metric; and correlating the wear profile and the one or more productivity metrics to determine a relationship between wear on the ground-engaging tool and efficiency losses in the operation of the machine.

18. A method for optimizing productivity of a machine based on wear of a ground-engaging tool associated with the machine, the ground-engaging tool defining an inner cavity and a first wall, the method comprising:

receiving a first characteristic signal associated with the first wall from a first sensor, the first sensor operatively associated with the first wall;

determining a first dimension of the ground-engaging tool based on the first characteristic signal;

determining a first wear metric of the ground-engaging tool based on the first dimension;

receiving one or more productivity metrics associated with a productivity or an efficiency of the machine from a performance monitoring system, the performance monitoring system operatively associated with the machine, and the productivity metrics being determined by the performance monitoring system based on a machine efficiency characteristic sensed by a performance monitoring system sensor; and correlating the first wear metric and the one or more productivity metrics over a period of time to determine a relationship between wear on the ground-engaging tool and efficiency losses in the operation of the machine.

19. The method of claim 18 further comprising replacing the ground-engaging tool with a replacement ground-engaging tool, with respect to the machine, if the productivity changes indicate that wear of the ground-engaging tool contributed to the productivity changes.

20. The method of claim 18, further comprising alerting an operator of the machine of the productivity changes over the period of time via an output device.

* * * * *